United States Patent [19]

Samson et al.

[11] Patent Number: 4,591,158

[45] Date of Patent: May 27, 1986

[54] REMOTELY CONTROLLED TOY GOLFER

[75] Inventors: Ronald Samson, 4 The Avenue, Blaby, Leicestershire; Russel J. Packwood, Bedford, both of England

[73] Assignee: Ronald Samson, Leicestershire, England

[21] Appl. No.: 421,068

[22] Filed: Sep. 22, 1982

[30] Foreign Application Priority Data

Sep. 22, 1981 [GB] United Kingdom ..... 8128564

[51] Int. Cl.[4] ..... A63F 7/06

[52] U.S. Cl. ..... 273/87.4; 446/288; 446/336; 446/456; 340/825.69

[58] Field of Search ..... 46/254, 210, 255, 266, 46/265, 264; 273/87 R, 85 F, 85 G, 87.4, 129 V, 119 A; 340/825.72, 825.69, 696; 414/909; 901/1; 446/288, 289, 290, 291, 308, 309, 330, 333, 334, 336, 358, 456, 352, 353, 354, 269, 279, 280, 292, 298, 273

[56] References Cited

U.S. PATENT DOCUMENTS

| | | | |
|---|---|---|---|
| 2,960,796 | 11/1960 | Woodrey | 273/87.4 X |
| 3,128,575 | 4/1964 | Stanetzki | 446/291 X |
| 3,199,249 | 8/1965 | Carver et al. | 46/210 X |
| 3,648,408 | 3/1972 | Terzian et al. | 446/291 |
| 3,858,116 | 12/1974 | Friedl et al. | 340/825.69 X |
| 3,892,079 | 7/1975 | Hirano et al. | 414/909 X |
| 4,040,206 | 8/1977 | Kimura | 446/352 |
| 4,239,217 | 12/1980 | Thieme et al. | 273/87.4 |
| 4,279,419 | 7/1981 | Barnes et al. | 273/87.4 |
| 4,346,893 | 8/1982 | Landsinger et al. | 46/262 X |

*Primary Examiner*—Mickey Yu

*Attorney, Agent, or Firm*—Charles E. Brown; Charles A. Brown

[57] ABSTRACT

A remotely controlled model golfer including a mobile unit and a remote control unit. The mobile unit includes a wheeled body carrying an upstanding figure at one end. The figure is in the general form of a golfer holding a golf club. The figure's arms are rigidly interconnected and pivoted intermediate their shoulders to allow the arms and thus the golf club to be "swung" through an angle of up to 180° by an electric motor subject to the control of the remote control unit. The remote control unit also controls forward and reverse motion and steering of the wheeled body. A set of interchangeable golf clubs are provided to enable an operator to "play" a game of golf using a miniature golf ball. Servo-drive circuits utilizing pulsed signal are employed for actuating driving and steering of the wheeled body and actuation of the electric motor for pivoting the figure's arms.

17 Claims, 7 Drawing Figures

REMOTELY CONTROLLED TOY GOLFER

The present invention relates to a remotely controlled toy having a mobile unit and a control unit.

In presently known model systems the mobile unit may be a model car, boat or aeroplane. It is an object of the present invention to provide a remotely controlled toy in which the mobile unit is capable of playing a game with a ball or other independent playing piece.

Accordingly, the present invention provides a remotely controlled toy having a mobile unit and a control unit, the mobile unit comprising a body structure housing drive means for driving said mobile unit, means for steering said mobile unit, play means actuable for engaging and moving a ball or the like, means for actuating said play means and wherein said control unit is operable to provide control signals for said drive means, steering means and actuating means.

In a preferred embodiment of the present invention the toy is in the form of a model golfer. The play means is in the form of a member pivotally mounted on the body structure, the member conveniently being shaped as a pair of arms rigidly interconnected in "V" form for decorative reasons. A golf club is integral with or detachably connected to the pair of arms so that the arms can be pivoted by the actuating means to "swing" the golf club and drive a toy golf ball.

Preferably the height of the play means is adjustable and the mobile unit and control unit are selectively operable in either one of a drive mode in which said drive means is operable and operation of said play actuating means is inhibited and a play mode in which said play activating means is operable and said drive means is inhibited.

Advantageously, when in said drive mode said steering means is operable to steer said mobile unit and when in said play mode said steering means is operable to adjust the height of said play means.

Preferably the mobile unit has a first servo-drive circuit for controlling said drive means and said actuating means in dependence on signals received from said control unit and switch means operable to connect said servo-drive circuit to said drive means or said actuating means independence on the selected operating mode of the mobile unit and the control unit, and a second servo-drive circuit operable to control said steering means in dependence on control signals received from said control unit.

The present invention is further described hereinafter, by way of example, with reference to the accompany drawings, in which.

Figure 1:
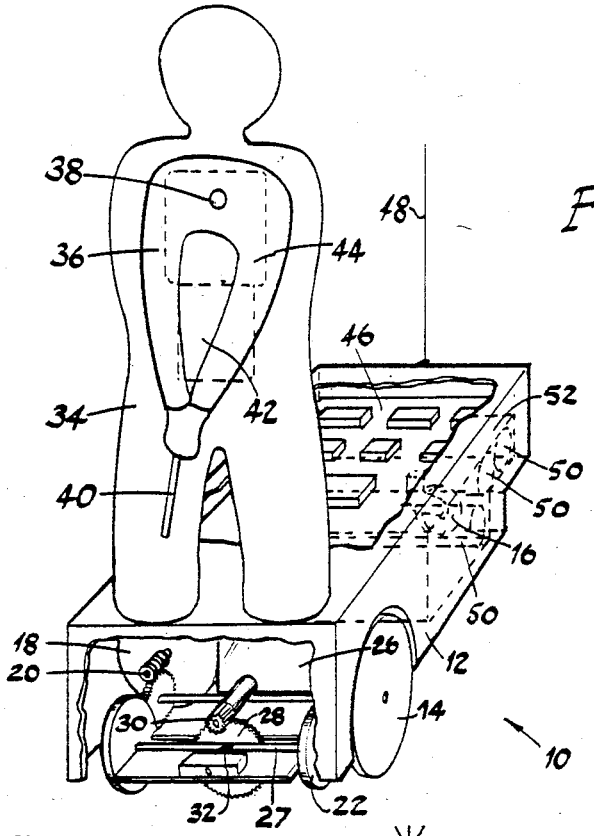
FIG. 1 is a partly cut away perspective view of a mobile unit forming part of a toy according to this invention.

Referring now to FIG. 1 there is shown a remotely controlled mobile unit 10 arranged as a model golf player, the remote control conveniently being effected through a radio link although any other suitable form of remote control may be used. The unit comprises a body structure 12 mounted on a pair of transversely disposed front drive wheels 14 (only one of which is shown in the drawing) and a rear wheel 16 which is mounted to castor freely. The drive wheels 14 are driven by an electric motor 18 through a worm gear 20, although any suitable form of gearing such as standard straight gearing could be used. The body structure has steering means in the form of a pair of skids 22 secured to a shaft 24 extending substantially parallel to the drive wheel axis. The shaft 24 is coupled to a further electric motor 26 which is operable to pivot the shaft 24, intermediate its end, in a substantially vertical or near vertical plane to effect lowering of one or the other of the two skids, the motor being coupled through a suitable gearing 28, 30 to a shaft 32 secured at right angles to the shaft 24.

The drive wheels 14 are adjacent one end of the body structure 12, the latter also carrying at this end a FIG. 34 which is in the shape of a golfer, the figure conveniently conforming to the stance of a golfer preparing to play a shot. The FIG. 34 has play means comprising a pair of arms 36 which are secured together and pivoted about a common pivot 38 intermediate the "shoulder" points of the arms. The arms are capable of holding a ball-engaging member in the form of a golf club, part of which is shown at 40, in the manner of a golfer. The FIG. 34 may be provided either with a single integral golf club or a set of interchangeable golf clubs. The arms 36 are pivoted by an electric motor 42 via a gear box 44 having an output shaft secured to the arms 36 at the pivot 38.

The body structure 12 also houses a receiver unit 46 which controls operation of the motors 18, 26 and 42, the receiver unit having a radio antenna 48 mounted at the rear of the body structure. The mobile unit 10 is powered conveniently by five nickel cadmium batteries, four of which are indicated at 50, in a compartment 52.

The mobile unit 10 has two operating modes, a drive mode and a "play" mode which in the present instance is a ball-engaging mode. In the drive mode the motor 42 is inoperative while the wheels 14 are driven by the motor 18 in order to drive the mobile unit forwards or backwards. Steering is effected by the skids 22 as mentioned above, the shaft 24 normally being maintained in a substantially horizontal attitude so that both skids are clear of the ground. Steering of the mobile unit is effected while the latter is moving, the motor 26 being operated to pivot the shaft 24 and lower one of the skids to engage the ground and raise the adjacent drive wheel 14 thus reducing or removing traction between the drive wheel and ground. The drive then becomes asymmetric and, since the rear wheel 16 can castor freely, the vehicle turns about the lowered skid 22. If one of the skids 22 is lowered while the mobile unit is stationary then the latter can be pivoted about the skid by operating the motor 18. This enables the golf club supported by the arms 36 to be positioned relative to the ball for a golf shot.

In the ball-engaging mode the motor 18 is inoperative. In this mode the height of the pivot point 38 and thus of the golf club swing arc may be raised by operating the motor 26 so that one of the skids 22 engages the ground to lift the front part of the mobile unit. To strike the ball the motor 42 is operated first to pivot the arms 36 and thus the golf club 40 in a clockwise direction as seen in FIG. 1 and then rapidly in an anticlockwise direction to hit the ball.

Figure 2:
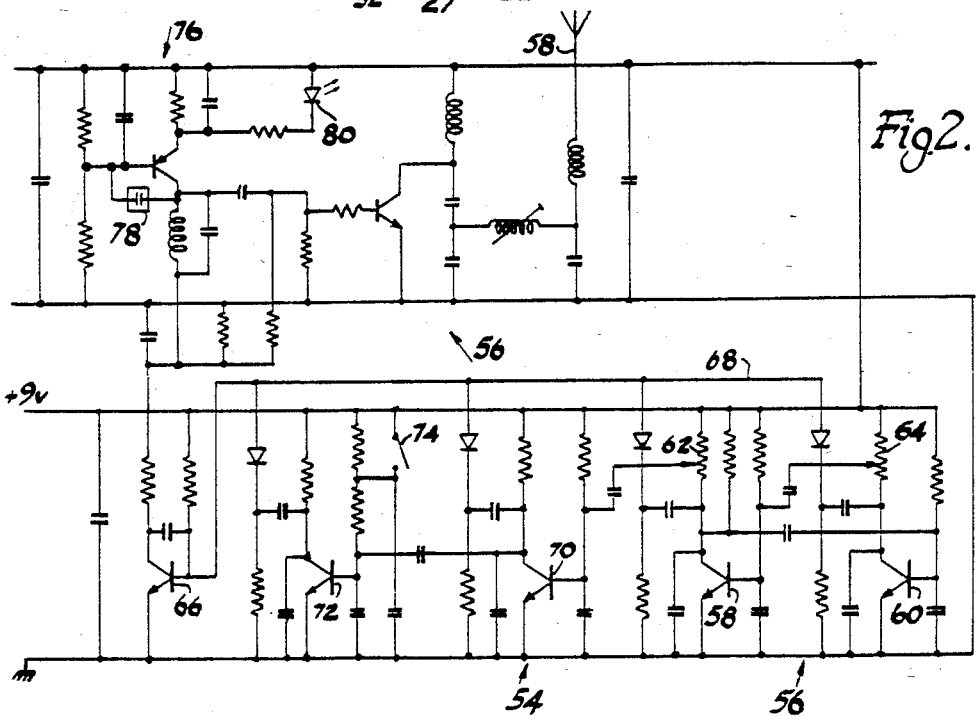
FIG. 2 is a circuit diagram of a control unit for operating the mobile unit shown in FIG. 1.

FIG. 2 shows a circuit diagram of a remote control unit for operating the mobile unit 10 of FIG. 1. The control unit comprises a pulse generator 54 coupled to a radio transmitter 56 which transmits control signals to the mobile unit through the transmitter antenna 58. The pulse generator 54 has an astable multivibrator 56 whose two transistors 58, 60 have respective collector loads formed by potentiometers 62, 64 whose sliders are moved by manually operated joy sticks. The potentiometer 62 controls the speed and direction of the motor 18 and thus of the mobile unit in the drive mode and the speed and direction of the motor 42 thus of the golf club swing in the play mode while the potentiometer 64 controls the motor 26 and thus the steering of the mobile unit in the drive mode and the height of the arm pivot 38 and thus of the golf club swing arc in the ball-engaging mode as is described further below.

Figure 3:
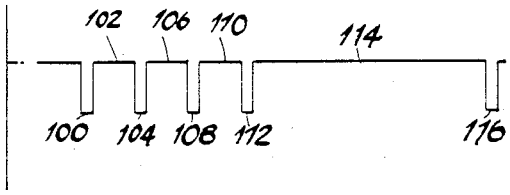
FIG. 3 shows a waveform appearing in the circuit of FIG. 2.

FIG. 3 shows the waveform appearing at the base of an output transistor 66 of the pulse generator during one complete cycle of operation of the latter. The negative pulse 100 is formed when the astable transistor 60 turns off. When this transistor turns on the transistor 58 is turned off for a duration determined by the setting of potentiometer 64 which thus controls the duration of the positive-going pulse 102 following the negative-going pulse 100. The duration of this pulse may be varied between 1 mS and 2 mS. The sliders of the two potentiometers 62, 64 are coupled to the output transistor 66 by a common connector rail 68 with the slider of the potentiometer 62 also being coupled to a first transistor 70 in turn connected to a second transistor 72, the collectors of both tansistors being coupled to the connector rail 68. When transistor 58 is turned on a negative-going pulse 104 is both applied to rail 68 and also turns off transistor 70. The off period being set by potentiometer 62 which thus controls the duration of the positive-going pulse 106 which follows pulse 104. Component values are selected so that the duration of pulse 106 also may vary between 1 mS and 2 mS. When transistor 70 turns on a negative-going pulse 108 is applied to rail and transistor 72 turns off, its off period being determined by the setting of a switch 74 connected in parallel with one of the base biassing resistors for transistor 72. Switch 74 consequently sets the duration of the positive-going pulse 110 which follows pulse 108. When transistor 72 turns on a negative-going pulse 112 is applied to rail 68 with a subsequent positive-going pulse 114 being applied to rail 68 until transistor 60 turns on thereby causing the next negative-going pulse 116. Component values of the pulse former are chosen such that the duration of pulses 102 and 106 may vary between 1 mS and 2 mS, pulse 110 has durations of 1 mS and 2 mS respectively with switch 74 closed and open and pulse 114 has a duration of approximately 15 mS.

As will be explained in more detail below the pulses 102 control the motor 26, pulses 106 selectively control either motor 18 or motor 42, pulses 110 control the mode in which the mobile unit operates, 1 mS and 2 mS duration corresponding respectively to the drive mode and the ball-engaging mode, and the pulses 114 are synchronising pulses. The pulses 102, 106 110 together provide three control channels for operating the mobile unit by remove control.

The transmitter comprises a transistor oscillator 76 whose collector and base are coupled by a crystal 78 and which has a light-emitting diode 80 as and "on" lamp. The oscillator operates at carrier frequency and is coupled to the output transistor 66 such that when a positive-going pulse renders transistor 66 conductive it permits operation of the oscillator 76 and when a negative-going pulse turns off transistor 66 oscillation is inhibited. Thus the carrier signal output of the oscillator 76 is amplitude modulated by the wave form shown in FIG. 3, this modulated signal being transmitted to the mobile unit via the antenna 58.

Figure 4:
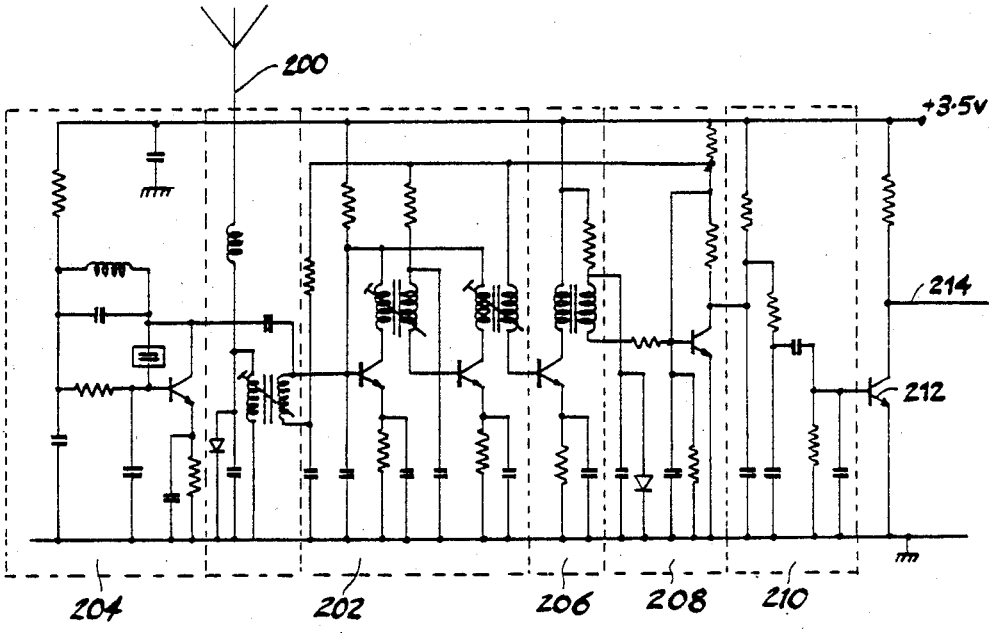
FIG. 4 is a circuit diagram of a radio receiver circuit of the mobile unit of FIG. 1.

FIG. 4 is a circuit diagram of the receiver of the mobile unit. The modulated signal from the transmitter 56 is received by an antenna 200 and applied to a mixer 202 together with a signal from a local oscillator 204 of the receiver. The mixer output is passed through an intermediate frequency amplifier 206 to a transistor and diode detector circuit 208. The output of the detector circuit is passed through a resistor-capacitor filter 210 and through a transistor 212 to the receiver output line 214. The signal appearing on the line 214 is the waveform shown in FIG. 3.

Figure 5:
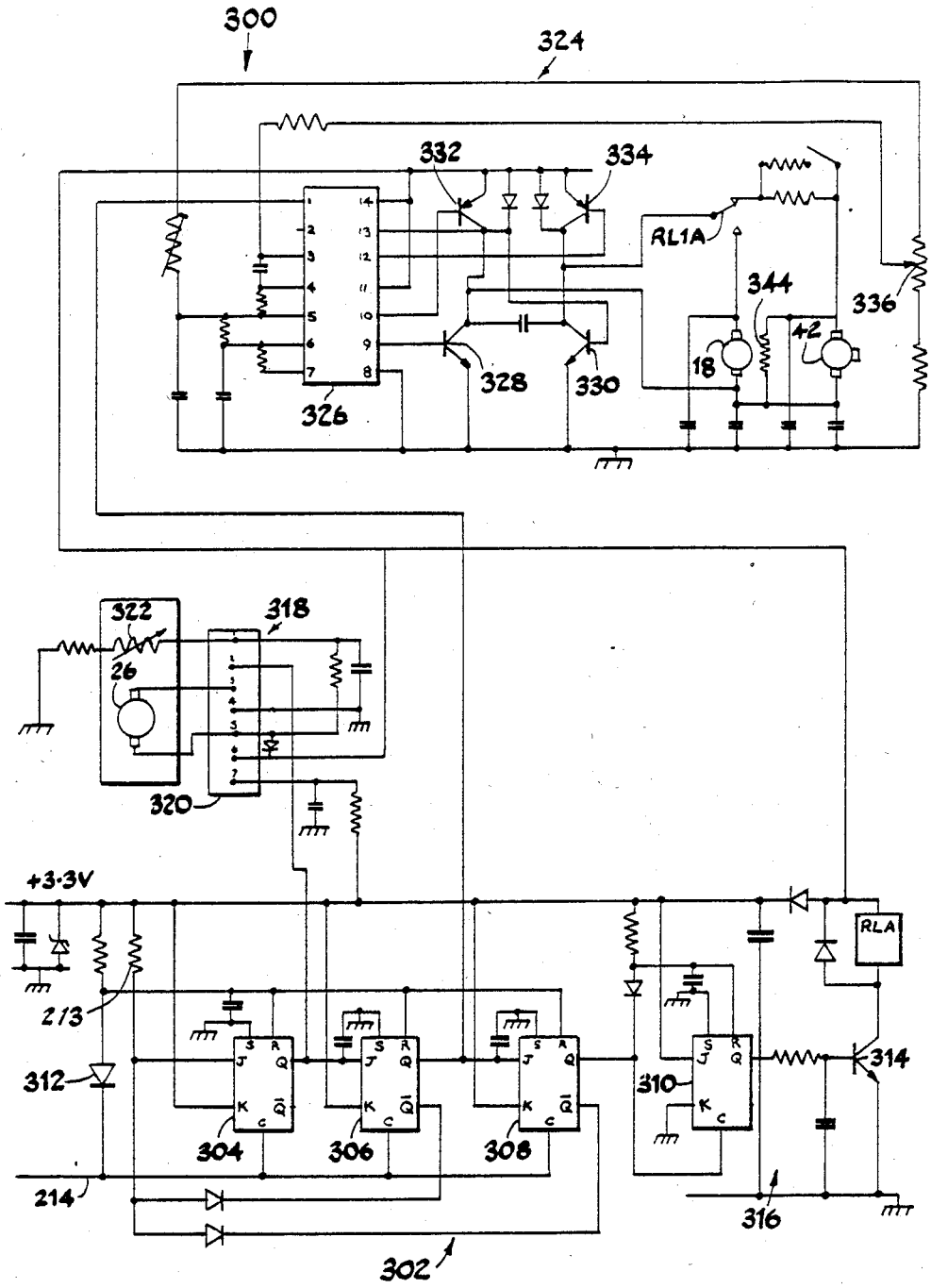
FIG. 5 is a circuit diagram of the remainder of the circuitry of the mobile unit.

The receiver is coupled to a motor drive unit 300, the circuit diagram of which is shown in FIG. 5. The output of the receiver is coupled to a drive control circuit 302 which has four JK flip-flops 304 to 310, each of which is formed by one half of a type 4027 integrated circuit. The set inputs S of the flip-flops are all connected to earth while the reset inputs R and clock inputs C are connected to the output line 214 of the receiver respectively through a diode 312 and directly, the reset inputs also being coupled through a resistor to a positive voltage line. The fourth flip-flop 310 controls a relay RL1 through a transistor 314 while its set input S is connected to earth, its reset input R through a resistor to the positive voltage line and through a diode to the Q output of flip-flop 308 to which its clock input C is also directly connected.

The synchronising pulse 114 reset all three flip-flops 304, 306 and 308. Then, the positive-going transitions following pulses 100, 104, 108 and 112 respectively sets flip-flop 304, resets flip-flops 304 and sets flip-flop 306, sets flip-flop 308 and resets flip-flop 306, and resets flip-flop 308. Consequently, pulse trains appear at the Q outputs of the flip-flops 304 to 308, the individual pulse durations of these pulse trains corresponding to the durations of the pulses 102, 106, and 110.

In operation, each positive-going pulse of the Q output of flip-flop sets flip-flop 310. When the switch 74 in FIG. 2 is closed the duration of each such pulse is 1 mS. This pulse is insufficient to cause flip-flop 310 to be reset and consequently its output is high and the relay RL1 is energised. When switch 74 is open the pulses are of 2 mS duration, flip-flop 310 is reset and a train of short duration pulses appear at its Q output. However, these are filtered by a resistance capacitance filter 316 before being applied to transistor 314 which therefore turns off and the relay RL1 is de-energised. The relay has a contact set RL1A which controls actuation of the motors 18 and 42. The relay RL1 determines the operating mode of the mobile unit: when energised the unit is in the drive mode and when de-energised the unit is in the ball-engaging mode.

The Q output of flip-flop 304 is connected to a servo-circuit 318 which controls operation of the motor 26, the servo-circuit including a motor drive circuit 320 which is conveniently a type AM6880. The output pulses of flip-flop 304 control the operating position of the motor 26 with a variable resistor 322 providing the necessary feedback information for the drive circuit 320. A pulse duration of 1.5 mS corresponds to a central position of the motor 26 with its extreme positions being determined by pulse durations of 1 mS and 2 mS respectively. As the duration of pulses 102 are set by potentiometer 64 it will be appreciated that this potentiometer controls steering of the vehicle in the drive mode and the height of the golf club pivot 38 in the ball-engaging mode.

A further servo-circuit 324 controls both the motors 18 and 42 and includes a further motor drive circuit 326 conveniently of the type uPC1035 which is connected to receive the Q output pulses of flip-flop 306. Terminals 9 and 13 of the drive circuit 326 are connected respectively to the basis of a pair of NPN transistors 328, 330 whose emitters are earthed and collectors capacitively coupled together. Terminals 10 and 12 are also connected respectively to the basis of a pair of PNP transistors 332, 334 whose emitters are connected to a positive supply line and whose collectors are connected respectively to the collectors of transistors 328 and 330. The collector emitter paths of transistors 332 and 334 are bridged by respective diodes. The collectors of transistors 330 and 334 are also connected to the movable contact of relay contacts RL1A which contact is switchable between two fixed contacts connected respectively through the motors 18 and 42 to the interconnected collectors of transistors 328 and 332. Positional feedback to the circuit 326 for the motor 42 is provided by a potentiometer 336. When relay RL1 is de-energised the collectors of transistors 330 and 334 are connected to motor 42 which is thus driven by the drive circuit 326. The duration of the pulses at the Q output of flip-flop 306 control the position of motor 42 and thus the pivoted position of the golfer arms 36. Since the pulse duration is controlled by the setting of potentiometer 62 this directly controls the position of the arms thereby providing accurate control over the golf club 40 when it engages the ball. The arms are preferably arranged to pivot a maximum of 90° in each direction from its lowermost position.

When the relay RL1 is energised the motor 18 is energised, putting the mobile unit into the drive mode. The duration of the pulses of the Q output of flip-flop 306 control the speed of motor 18 and thus the speed of the mobile unit. A pulse duration of 1.5 mS corresponds to the vehicle being stationary and pulse durations of 1 mS and 2 mS correspond respectively to full forward and reverse speeds. Thus in this mode of operation the setting of potentiometer at 62 controls the unit speed.

It will be appreciated that by providing two modes of operation of the unit only one motor drive circuit 326 is required for both motors 18 and 42 and also only one joy stick for controlling these motors.

Figure 6:
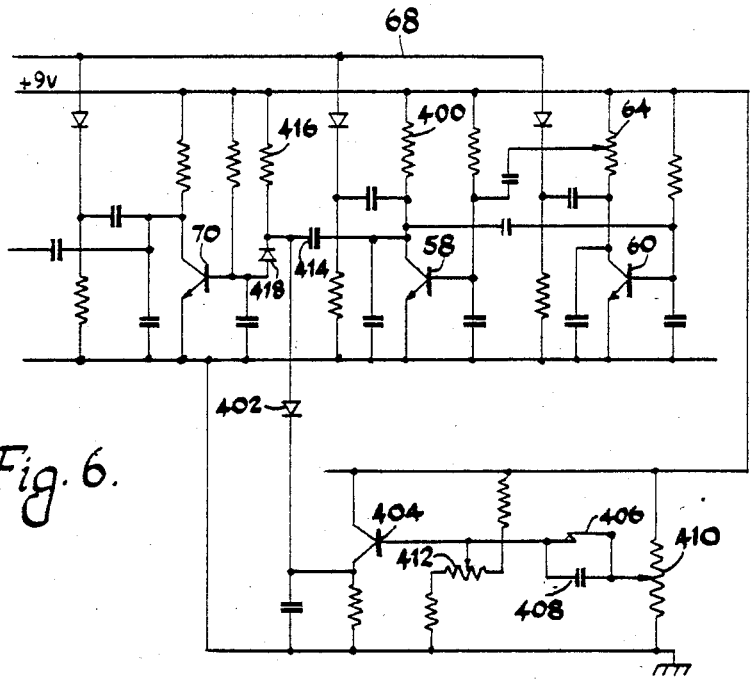
FIG. 6 shows a modification to the circuit of FIG. 2.

FIG. 6 shows a modification to the astable multivibrator 56 of FIG. 2 in which the potentiometer 62 is replaced 58 by a fixed resistor 400 and the collector of transistor 58 is also connected to the positive voltage supply through a series capacitance 44 and resistance 416 the junction of which is coupled to the base of transistor 70 via a diode 418. The junction is also coupled through an additional diode 402 to the output of an emitter follower transistor 404 whose base is coupled through a parallel switch 406 and capacitor 408 to a potentiometer 410 connected across the voltage supply. The base of the transistor 404 is also connected to a variable resistor 412 forming part of a resistor biass chain. The switch 406 is ganged with switch 74 so that both switches open and close together.

The slider of potentiometer 410 is actuated by one of the joy sticks to control the motor 42. The feedback potentiometer 336 is no longer required as a feedback element but is used as a "set zero" potentiometer for the motor drive circuit 326.

In operation, when the mobile unit is in the drive mode the switch 406 is closed and potentiometer 410 controls the voltage at the output of transistor 404, thereby controlling the duration of the pulses 102. The operation in this mode is generally similar to that previously described.

In the ball-engaged mode the switch 406 is open so that, with no adjustment of the potentiometer 410 the voltage at the emitter of transistor 404 is determined by the setting of the variable resistor 412. This resistor is pre-set so that the pulse duration is approximately 1.5 mS and the motor 42 is inactive. When the slider of potentiometer 410 is moved a change in the pulse duration occurs whilst the slider is moving and thereby causes rotation of motor 42. The rate of rotation would depend on the rate at which the potentiometer slider is moved.

Figure 7:
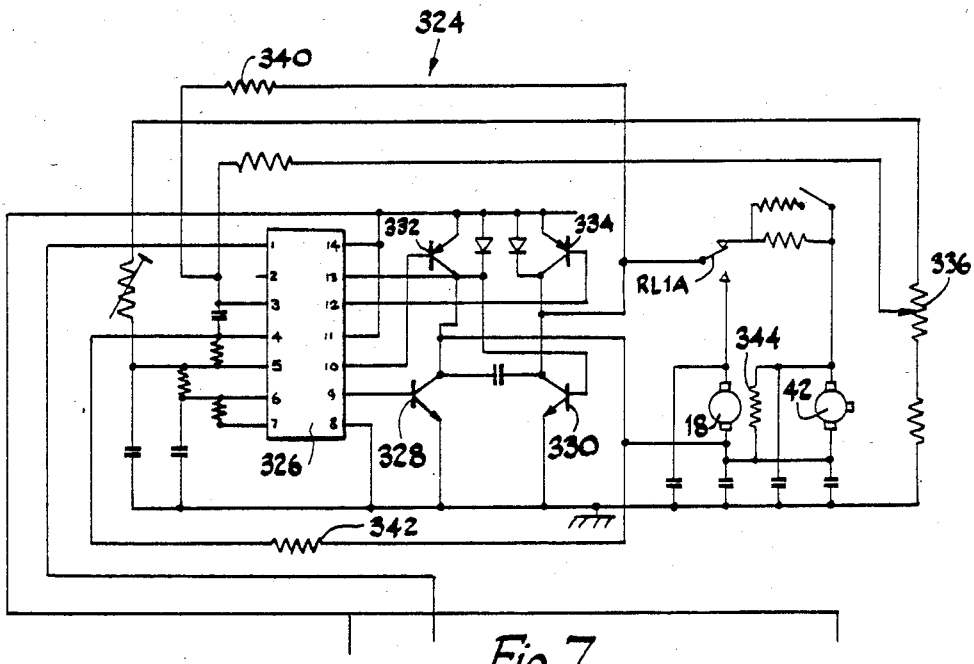
FIG. 7 shows a modification to the circuit of FIG. 5.

FIG. 7 shows a modification to the servo-circuit 324 in which the input to the relay contacts RL1A is connected through a resistor 340 to terminal 3 of the drive circuit 326 and the motor terminals remote from the relay contacts are connected through a resistor 342 to terminal 4 of the drive circuit. This reduces the "overswing" of the golf club in "full drive" shots when maximum length swing is used. A resistor 344 connected across motor 42 acts as a partial short to the motor back e.m.f. to improve low speed performance. The resistance value may be variable, for example by manual switching of several resistors or using a potentiometer to vary the power applied by the motor to the golf club, the higher the resistance the lower the power.

Remote control may be effected by, for example, infa red or sonic control instead of radio control.

The angle of movement of the arms 36 and thus the club 40 is not critical but may be up to about 180° and the arms should be free to swing beyond the normal limit to allow for some overswing on full power shots.

The travel angle on the control lever or joystick for the motor 42 is preferably 90° although any angle between 60° and 90° may be used, the travel angle on the steering control lever or joystick being 60°.

Additional adjustment of the arm pivot 38 height may be provided for example by hinging the FIG. 34 at the waist.

We claim:

1. A remotely controlled toy comprising a mobile unit and a control unit, said mobile unit including a body structure, drive means in said body structure for driving said mobile unit, steering means carried by said body structure for steering said mobile unit, said body structure including a golfer figure, play means in the form of simulated golfer's arms, a golf club having a striking portion, said golf club being attached to said golfer's arms for engaging and moving a ball, pivot means pivotally mounting said golfer's arm on said golfer figure for enabling said golfer's arms and said golf club to pivot in a generally upright plane for swinging movement in an arc between first and second elevated angular positions and through an intermediate lowermost position to strike a ball positioned adjacent said mobile unit at one end of said mobile unit during said swinging movement, said body structure being beyond the path of said golf club, play actuating means connected to said play means for actuating said golfer's arms to pivot said golfer's arms and said golf club between said first and second elevated angular positions, and wherein said control unit has means for transmitting control signals to said mobile unit for controlling said drive means, said steering means and said play actuating means.

2. A toy as claimed in claim 1 comprising means in said golfer's figure for adjusting the height of said golfer's arms relative to a supporting surface for said body structure.

3. A toy as claimed in claim 1 wherein the mobile unit and control unit are selectively operable in either one of a drive mode in which said drive means is operable and operation of said play actuating activating means is inhibited and a play mode in which said play actuating means is operable and said drive means is inhibited.

4. A toy as claimed in claim 1 wherein said drive means include at least a pair of drive wheels and said steering means comprises means for controlling the traction applied by each of said drive wheels.

5. A toy as claimed in claim 4 wherein said steering means comprises a pair of ground-engaging members, each associated with and vertically movable relative to a respective one of the drive wheels, and means for vertically moving each said ground-engaging member relative to its associated drive wheel to raise the drive wheel relative to the ground.

6. A remotely controlled toy having a mobile unit and a control unit, wherein the mobile unit comprises a body structure, drive means in said body structure for driving said mobile unit, means for steering said mobile unit, play means mounted on said body structure and actuatable for engaging and moving a ball or the like, means connected to said play means for actuating said play means and wherein said control unit has means for transmitting control signals to said mobile unit for controlling said drive means, said steering means and said actuating means, the mobile unit and control unit being selectively operable in either one of a drive mode in which said drive means is operable and operation of said play actuating means is inhibited and a play mode in which said play actuating means is operable and said drive means is inhibited, said mobile unit having a first servo-drive circuit for controlling said drive means and said actuating means in response to signals received from said control unit and switch means operable to connect said servo-drive circuit to said drive means or said actuating means in dependence on the selected operating mode of the mobile unit and the control unit, and a second servo-drive circuit operable to control said steering means in dependence on control signals received from said control unit.

7. A toy as claimed in claim 6 wherein said mobile unit has a drive control circuit connected to said first and second servo-drive circuits and said switch means and operable responsively to control signals from said control unit to control said switch means to connect said first servo-drive circuit to a selected one of said drive means and said actuating means and to control operation of said steering means and said selected one of said drive means and said actuating means.

8. A toy as claimed in claim 7 wherein said drive control circuit controls said first and second servo-drive circuits and said switch means is actuatable in dependence on the pulse width of control signal received from the control unit.

9. A toy as claimed in claim 6 wherein said control unit comprises a signal generator operable to generate a first control signal for controlling said steering means, a second control signal for controlling said drive means or said actuating means and a third control signal for controlling the operating of said mobile unit.

10. A toy as claimed in claim 9 wherein said signal generator is a pulse generator, said control signals are control pulses and control is effected by varying a parameter of said pulses.

11. A toy as claimed in claim 10 wherein said pulse generator is operable to generate a series of operating pulse cycles wherein each cycle comprises a first control pulse for controlling said steering means, a second control pulse for controlling said drive means or actuating means and a third control pulse for controlling the operating mode of said mobile unit and control unit.

12. A toy as claimed in claim 11 wherein each cycle further comprises a synchronising pulse.

13. A toy as claimed in claim 11 wherein said parameter is the pulse width.

14. A toy as claimed in claim 13 wherein said second servo-drive circuit is operable to compare the pulse width of said first control pulse with a reference value and control the direction of steering of the mobile unit in dependence thereon.

15. A toy as claimed in claim 13 wherein said second servo-drive circuit is operable to compare the pulse width of said second control pulse with a reference value and move said mobile unit or of said play means in a forward or reverse direction in dependence on whether said control pulse width is greater or less than said reference value and to control the speed of movement of said mobile unit in dependence of the magnitude of the difference in pulse widths.

16. A toy as claimed in claim 13 wherein the speed of movement of said play means is dependent on the rate of change of said second control pulse width when said mobile unit and control unit are in said play mode.

17. A remotely controlled toy comprising a mobile unit and a control unit, said mobile unit including a body structure, drive means in said body structure for driving said mobile unit, steering means carried by said body structure for steering said mobile unit, play means, a ball engaging member of the type having a striking portion, said ball engaging member being attached to said play means for engaging and moving a ball-like member, pivot means pivotally mounting said play means on said body structure for enabling said play means and said ball engaging member to pivot in a generally upright plane for swinging movement in an arc between first and second elevated angular positions and through an intermediate lowermost position to strike a ball-like member positioned adjacent said mobile unit at one end of said mobile unit during said swinging movement, said body structure being beyond the path of said ball engaging member, play actuating means connected to said play means for actuating said play means to pivot said play means and said ball engaging member between said first and second elevated angular positions, and wherein said control unit has means for transmitting control signals to said mobile unit for controlling said drive means, said steering means and said play actuating means, means in said body structure for adjusting the height of said play means relative to a supporting surface for said body structure, the mobile unit and control unit being selectively operable in either one of a drive mode in which said drive means is operable and operation of said play actuating means is inhibited and a play mode in which said play actuating means is operable and said drive means is inhibited, and when in said drive mode said steering means being operable to steer said mobile unit and when in said play mode said steering means being operable to adjust the height of said play means relative to a supporting surface for said body structure.

* * * * *